US006432007B1

(12) United States Patent
Filice et al.

(10) Patent No.: US 6,432,007 B1
(45) Date of Patent: Aug. 13, 2002

(54) GOVERNED PERFORMANCE HARD SHELL BAT

(75) Inventors: Gary W. Filice, Van Nuys; Dewey Chauvin, Simi Valley, both of CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/628,935

(22) Filed: Jul. 28, 2000

Related U.S. Application Data

(63) Continuation-in-part of application No. 09/525,237, filed on Mar. 15, 2000, now Pat. No. 6,334,824, which is a continuation-in-part of application No. 09/375,833, filed on Aug. 16, 1999, now Pat. No. 6,248,032.

(51) Int. Cl.[7] ..... A63B 59/06
(52) U.S. Cl. ..... 473/566
(58) Field of Search ..... 473/564–568, 473/457, 519, 520

(56) References Cited

U.S. PATENT DOCUMENTS

| | | | | |
|---|---|---|---|---|
| 3,727,295 A | | 4/1973 | Gildemeister | |
| 3,729,196 A | | 4/1973 | Heald, Jr. | |
| 3,801,098 A | | 4/1974 | Gildemeister | |
| 3,963,239 A | | 6/1976 | Fujii | |
| 4,025,377 A | * | 5/1977 | Tanikawa | 473/566 |
| 4,848,745 A | * | 7/1989 | Bohannan et al. | 473/567 |
| 5,104,123 A | | 4/1992 | Okitsu | |
| 5,114,144 A | | 5/1992 | Baum | |
| 5,395,108 A | | 3/1995 | Souders et al. | |
| 5,458,330 A | | 10/1995 | Baum | |
| 5,460,369 A | | 10/1995 | Baum | |
| 5,511,777 A | | 4/1996 | McNeely | |
| 5,533,723 A | | 7/1996 | Baum | |
| 5,964,673 A | | 10/1999 | Mackay, Jr. | |
| 6,248,032 B1 | * | 6/2000 | Filice et al. | 473/566 |

* cited by examiner

*Primary Examiner*—Mark S. Graham
(74) *Attorney, Agent, or Firm*—Roth & Goldman, PA

(57) ABSTRACT

A governed performance hard shell bat designed to ensure ball exit speed approximating and not exceeding that of a wood bat of comparable weight and geometry is comprised of a thin wall hard shell such as reinforced resin composite or of metal such as aluminum or titanium or alloys thereof filled with light weight semi-rigid material such as a syntactic foam in the hitting area, the bat having longitudinal flexibility approximating that of a similarly shaped wood bat. The filler material has a sectional density and hardness correlated with the thickness of the metal shell wall in the hitting area and may be cast in the thin wall hard shell or it may be pre-formed and subsequently inserted into the shell. The filler has a sectional density in the range of from 10–30 lbs./cu. ft.

25 Claims, 2 Drawing Sheets

GOVERNED PERFORMANCE HARD SHELL BAT

CROSS REFERENCE TO RELATED APPLICATIONS, IF ANY

This application is a continuation-in-part of our prior application Ser. No. 09/525,237 filed Mar. 15, 2000 U.S. Pat. No. 6,334,824 which in turn is a continuation in part of our prior application Ser. No. 09/375,833 filed Aug. 16, 1999 U.S. Pat. No. 6,248,032

BACKGROUND OF THE INVENTION AND PRIOR ART

1. Field of the Invention

The present invention relates to hard shell tubular bats having an exterior shell of metal or composite, and more particularly, to aluminum baseball bats which currently are used at the college and lower levels. Such bats typically include a metal shell formed of resin composite, aluminum or titanium alloy or other metals, such bats being used not only in baseball but also in softball at such substantially all levels of non-professional levels of play. As referred to herein, the terms "aluminum" and "titanium" are intended to encompass the metals and alloys and mixtures of metals and alloys formulated for the manufacture of bat shells.

Recently, the National Collegiate Athletic Association (NCAA) has indicated that, for player safety reasons, the batted ball exit speed for non-wood bats should equate to or not exceed the highest average exit speed using major league baseball quality, 34 inch solid wood bats. Bats meeting these specifications are expected to result in lower incidences of harm to ball players and moderate the game offense. A typical 34" wood bat has a moment of inertia in the range of about 10,500–12,000 oz.-in.$^2$ and it is therefore contemplated that tubular hard shell bats should have a moment of inertia not less than 10,500 oz.-in.$^2$ or thereabout. Moment of inertia testing is performed by determining the bat weight in ounces and the balance point location in inches then pivotally supporting the bat 6 inches from the knob end to swing as a pendulum and and timing the average swing period over not less than 10 cycles.

2. Prior Art

Tubular bats formed of a hard outer shell and a reinforcing or shock dampening inner layer which may comprise solidified foam therein are known. For example, U.S. Pat. No. 5,395,108 Souders, et al issued Mar. 7, 1995 for a SIMULATED WOOD COMPOSITE BALL BAT comprises a fiber reinforced composite shell filled with expansible urethane foam to develop compressive stresses therebetween and U.S. Pat. No. 5,364,095 issued Nov. 15, 1994 to Easton, et al discloses a tubular metal ball bat internally reinforced with fiber composite.

U.S. Pat. No. 5,114,144 issued May 19, 1992 to Baum discloses a composite baseball bat made to look like a wood bat by using a central core of foamed plastic (foam density of 5–15 lbs/cu. ft.) or extruded aluminum covered with a layer of resin impregnated fiber knitted or woven cloth and a surface layer of longitudinally extending planks or strips of resin coated wood veneer; U.S. Pat. No. 5,458,330 issued Oct. 17, 1995 to Baum discloses a composite bat having a wood veneer surface and cavitied foam core; and U.S. Pat. No. 5,460,369 issued Oct. 24, 1995 to Baum discloses a composite bat having a wood veneer surface bonded to a composite tubular core. Also, U.S. Pat. No 5,533,723 issued Jul. 9, 1996 to Baum discloses a composite bat having a wood veneer surface and intermediate composite layer bonded to a tubular core of composite or aluminum. The core may comprise a resilient urethane foam and a cavity may be left in the core in the hitting area and the cavity may be filled with less dense material. The core may vary in density over the length of the bat, preferably with a higher density section near the barrel end.

OBJECT OF THE INVENTION

The primary objective of the invention is to provide a durable hard shell baseball bat in which the ball rebound characteristics approximate those of a wood bat by emulating the longitudinal flexibility and cross sectional rigidity characteristics of a wood bat of similar size and shape whereby the speed of the batted ball is approximately the same as would be experienced with a wood bat of similar weight, shape and size.

SUMMARY OF THE INVENTION

The present invention provides a governed performance ball bat comprising:

a) a tubular exterior shell having a maximum outside diameter in a ball hitting area and a ratio of said maximum outside diameter to the wall thickness of the shell in the hitting area in the range of from 40:1–90:1; and b) a filler contacting and internally supporting an annular interior surface of the bat shell in the hitting area, said filler having a sectional density in the range of 10–30 lbs./cu. ft. and a hardness on a Shore D test apparatus in the range of 25–65.

The present invention further provides a governed performance aluminum shell ball bat comprising:

a) an aluminum alloy shell having a ratio of maximum outside diameter to the wall thickness of the shell in the ball hitting area in the range of from 45:1–75:1; and b) a foam material contacting and internally supporting the bat shell in the hitting area, said foam having a sectional density in the range of 10–30 lbs./cu. ft. and a hardness on a Shore D test apparatus in the range of 40–65, said bat having longitudinal flexibility characteristics approximating those of a wood bat of identical geometry.

DESCRIPTION OF THE PREFERRED EMBODIMENT

Figure 1:
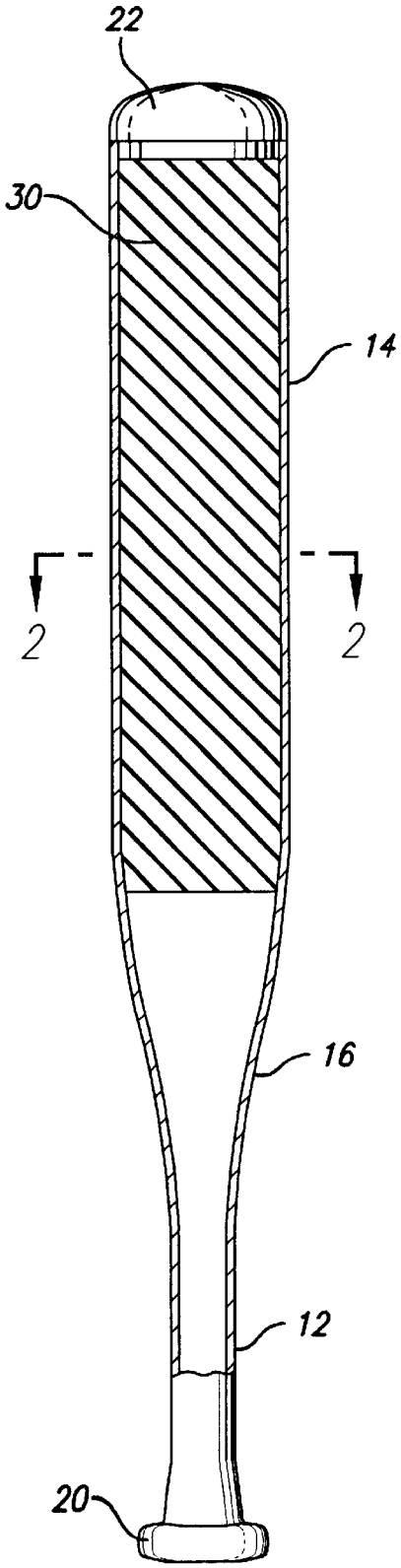
FIG. 1 is a longitudinal cross-section of a bat according to the present invention.
Figure 2:
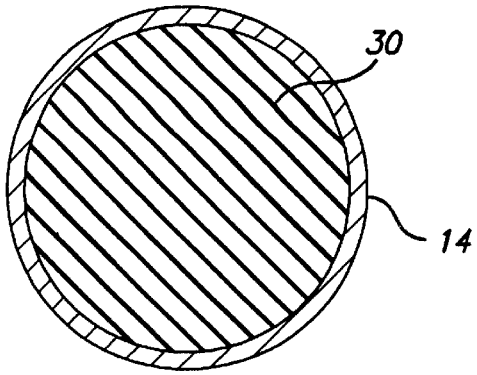
FIG. 2 is a transverse cross-section, taken through the hitting area, of the bat of FIG. 1.

As seen in FIGS. 1 and 2, the baseball bat comprises a hard exterior shell of composite construction or of metal or metal alloy, preferably aluminum, 10 having a handle 12, a barrel 14 and a tapered section 16 interconnecting the handle and the barrel. A knob 20 closes the handle end of the bat and a plug 22 is typically affixed to the barrel end of the bat as is well known. The ball hitting or striking area of the bat generally extends through the full length of the barrel section 14 partially into the tapered section 16 of the bat.

Performance of the bat of the present invention is intentionally designed to match or closely approximate the performance of a typical wood bat of similar weight and geometry by emulating the longitudinal flexibility and cross sectional rigidity of the wood bat. Wood is very flexible in bending, and therefore reduces the effective leverage produced by the batter. At the same time, the high cross sectional rigidity of the solid wood bat produces little, if any, of the so called "trampoline effect" and resulting higher batted ball velocity generated by typical aluminum bats.

Since metals such as aluminum and titanium alloys have a much higher elastic modulus than wood, if a metal shell bat were made with the same approximate outside shape or geometry as a correspondingly shaped wood bat, the metal shell bat would have a substantially higher longitudinal stiffness of as much as, in the case of aluminum alloy, 2.5 to 3.0 times that of the wood bat. Increasing the longitudinal flexibility of a metal shell bat to approximate that of a wood bat requires a great reduction of the shell wall thickness. A wall thickness reduction to achieve the desired increase in longitudinal flex, results in a bat diameter to wall thickness ratio found through experimentation to be about 67:1 for an aluminum shell bat. This creates another problem since the wall is now thinner than is necessary to stand up to the rigors of the game without incurring permanent distortion by denting. Also, substantial thinning of the wall of a metal shell bat, without more, generally results in undesirable higher ball rebound velocity due to more significant flexing of the bat wall, commonly referred to as "trampoline effect". In comparison, wood bats have a high cross-sectional stiffness (low trampoline effect) which is well able to resist ball impacts.

Known prior art composite bats and metal shell bats with resilient walls are intentionally designed to permit localized flexing of the outer bat shell wall to generate a rebound or trampoline effect following impact with a batted ball to propel the ball with added velocity. Since an objective of the present invention is to govern or reduce the speed of the batted ball to no more than would be experienced with a wood bat, a bat having a reduced bat shell wall thickness to increase longitudinal flex in combination with a semi-rigid low density material which acts as an impact resistant filler 30 in the hitting area to minimize or substantially eliminate the trampoline effect has been developed. In the preferred embodiment, the semi-rigid, low density material forming the filler 30 is a foam, more specifically a light weight syntactic foam, i.e., a foam having microspheres or the functional equivalent entrained therein; however, persons skilled in the art will appreciate that a multitude of other materials may be chosen to achieve equivalent results. Without limitation, the filler 30 may comprise packed spheres of light weight materials (e.g., glass or plastic micro-spheres or mixtures thereof), plastic beads (e.g., of propylene, polyethylene and nylon), light weight particulate materials such as flour, corn starch, sand and mixtures thereof; and blown thermoset or thermoplastic foams (e.g. polyurethane, nylon, polystyrene). The filler 30 may be cast in place in the shell or it may be pre-formed and subsequently inserted therein. A void space in the end of the barrel 14 extending about 1" from the barrel end plug 22 bat may be allowed to remain.

The shell is preferably comprised of an aluminum alloy such as K749 designed such that the bat has a geometry and an end to end flexibility which approximates that of a correspondingly shaped wood bat. The outside diameter of the aluminum alloy barrel 14 has a much thinner wall in the hitting area (generally the barrel 14 and part of the tapered section 16) than conventional aluminum bats. Typical prior art aluminum shell bats have an outside handle diameter of about 0.880 inches to 0.890 inches and a shell wall thickness in the range of about 0.080 inches to in excess of 0.100 inches. In the present invention when using aluminum alloy for the shell material, the shell wall thickness is in the range of about 0.039 inches to 0.055 inches, preferably 0.045 inches to 0.050 inches. If titanium is used for the shell material, the wall thickness must be further reduced to obtain the desired longitudinal flex, i.e., to as low as about 0.030 inches.

The ratio of the outside diameter of the barrel 14 to the wall thickness of the shell in the hitting area is in the range of from 40:1–90:1 depending on the shell material used, the preferred range for aluminum alloy being about 45:1 to 75:1 and, for titanium, somewhat higher. Bat shells made of composite materials such as resin reinforced with carbon or fiberglass strands are also contemplated within the teachings of the present invention but have not yet been constructed and tested. In comparison, typical prior art aluminum bats exhibit a diameter to wall thickness ratio of about 20 to 25:1. The relatively thin wall shell 10 is used in conjunction with a semi-rigid (as compared with prior art resilient fillers used to dampen shock) filler 30, which in the preferred embodiment, comprises a syntactic foam which substantially fills the interior of the bat shell 10 in the hitting area yet results in a longitudinally more flexible hard shell bat which approximates the performance characteristics of a similarly shaped wood bat. Syntactic foam is a plastic non-blown resin foam having bubbles mixed in as by mixing microspheres with the resin components rather than by forming bubbles in the resin during curing of the foaming components.

As previously stated, other materials can be used to provide a relatively lightweight and incompressible filler to provide internal support for the thin wall bat shell 10. For example a blown foam in which a gas or other blowing agent to blow microbubbles into a thermoplastic or thermoset resin matrix may be used or even a packed particulate material such as flour, corn starch, sand or glass or plastic microspheres may be used to form the filler 30. It has been found that a filler material having a density in the range 10–35 lbs./cu. ft. and a hardness, when measured on a Shore-D test apparatus, in the range of 25 to 65 is required to adequately provide internal support for a thin wall aluminum shell 10 as described. At the present time, applicant prefers to use di-cyclopentadiene (DCPD) resin which is a thermosetting resin foam having microspheres mixed therein. Metallic foam structures are also contemplated.

In order to attain the objectives of the invention, a carefully controlled relationship between the strength and density of the foam filler 30 and the wall thickness of the metal shell 10 in the hitting area must be maintained. In general, lower filler densities can be used for thicker shell wall thicknesses without materially affecting the weight of the bat. As the shell wall thickness decreases, a more dense filler is required to maintain proper weight and balance. Also, the filler 30 must be harder to minimize radial displacement of the shell 10 during ball impact. As the bat size increases, a lighter filler 30 is required so the bat does not become too heavy.

Figure 3:
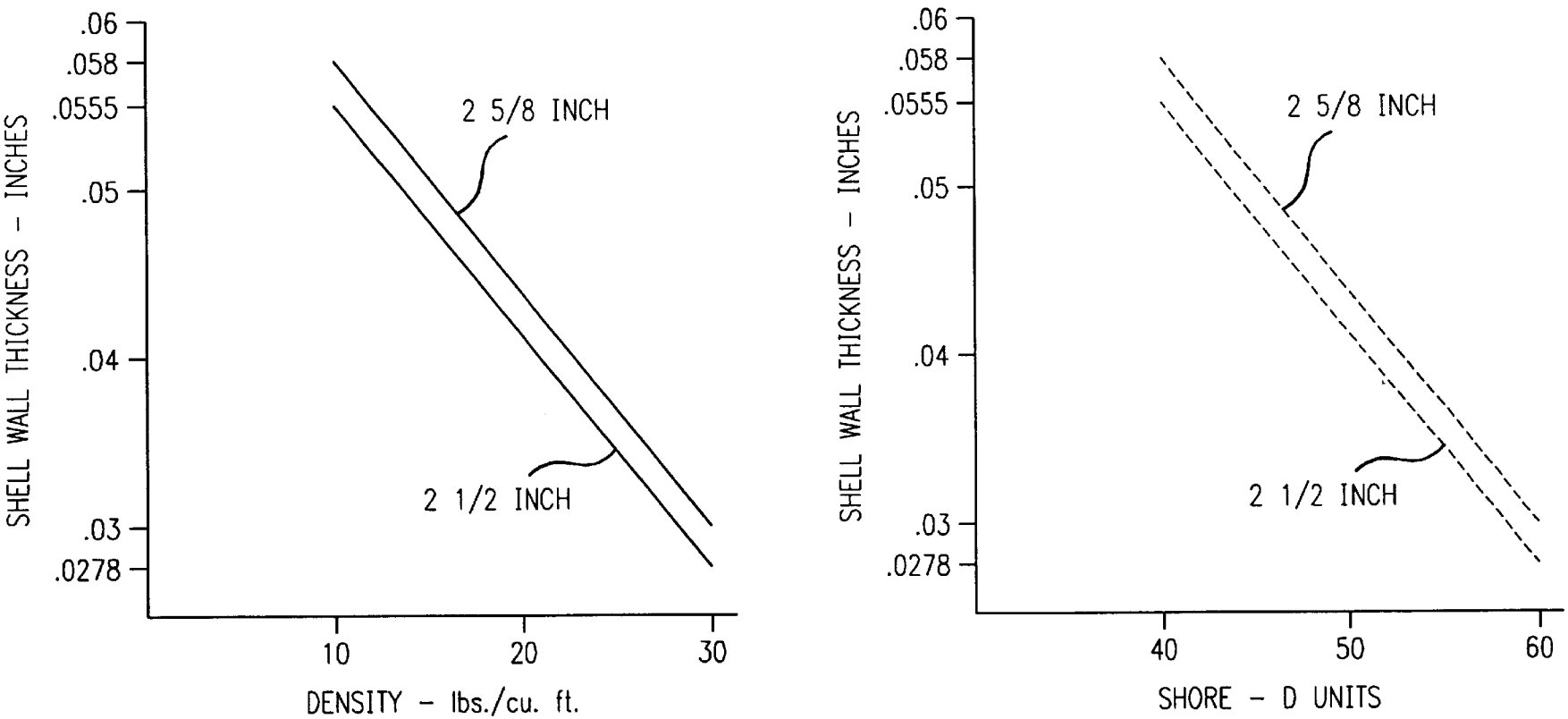
FIG. 3 is a graph illustrating the relationship of various bat parameters including outside diameter in the hitting area, shell wall thickness, density and Shore D hardness of a foam filler.

FIG. 3 shows two families of curves respectively relating filler density and hardness to shell wall thickness, one for a bat having 2 ⅝ inch outside diameter bat and the second for a bat having a 2 ½ inch outside diameter. The density curves are shown in solid lines and the hardness curves are shown in dashed lines. The shell wall thickness in inches is shown on the ordinate and the density, expressed in lbs/cu. ft. and the hardness, expressed as Shore-D units, are each shown on the abscissa. Typically, a 2 ⅝ inch metal shell bat should have a shell wall thickness in the range of from 0.030 inches to about 0.55 inches so that the shell is adequately flexible without becoming too heavy. With future advances in Al or Ti strength it may even be possible in the future to use thinner metal shell walls than those stated herein. For an aluminum shell using currently available materials, the minimum wall thickness should be not less than 0.039 inches. If a stronger metal such as titanium is used, 0.032 inches appears to be the minimum acceptable workable shell wall thickness to achieve wood like flexibility. The final wall thickness may be adjusted as necessary to achieve a fine tuned flexural rigidity and dynamic compressive response comparable to a wood bat depending on the filler material used.

A lighter foam having a sectional density as low as 10 lbs./cu. ft. should be used with thicker bat shell walls whereas a heavier foam having a sectional density of as high as 35 lbs./cu. ft. is required when the shell wall thickness is at the lower end of the acceptable range. A thick shell wall of about 0.050 inches for an aluminum shell bat, being relatively heavy, requires a filler density of only about 20 lbs./cu. ft. and has been found to be a marginal combination in resisting denting. A filler hardness of about 40 on a Shore-D test apparatus has been found to be adequate provided the shell wall thickness is near the upper end of the range, e.g., (about 0.050 inches for aluminum) but a harder filler material is required when the thickness of the shell wall in the hitting area decreases. Since harder filler materials are generally heavier, perforations 32 in the annular wall of the filler 30 may be provided to reduce the weight as discussed below without sacrificing necessary strength. Also shown on the graph are similar curves for a 2 ½ inch aluminum shell bat which will have correspondingly lower shell wall thickness, foam density and filler hardness.

The filler 30 may be introduced into the bat shell 10 in the hitting area in various ways, for example, by pressing in a pre-molded foam core either while the foam is still malleable or after it is fully cured, or by transfer molding, injection molding, infusion molding or by pouring uncured resin and hardener components and microspheres together into the bat shell 10 and allowing the resin foam to cure in place. If a foam filler is used, preferably, the foam should have a shrinkage factor of less than 1% during curing to prevent the formation of void spaces either during the filling process or during ordinary use of the bat between the inner surface of the shell 10 and the foam filler 30 or internally of the foam itself. To obtain maximum durability, careful attention to each step of the bat assembly, e.g., pressing the filler in place, is particularly required if the foam shrinkage exceeds the desired limit to minimize or eliminate voids. Bats constructed as described have moments of inertia which substantially meet or exceed the proposed minimum moment of inertia criteria of 10,500 oz.-in.$^2$ for a 34 inch length.

Although an adhesive bonding agent may be used, it should be noted that no adhesive bonding agent between the metal shell 10 and a foam filler 30 such as syntactic foam is essential necessary or even may be desirable, particularly if the foam is injected or poured into the shell and is cured in place, since bonding agents may cause degradation of the outer portion of the foam core and since resin foams typically expand during the curing process resulting in significant compressive interengagement between the filler 30 and the shell 10 without the use of an added bonding agent. Also, a metal shell 10 made of aluminum may be heated during the manufacturing process to expand to a diameter greater then nominal, the shell then being allowed to cool and shrink to its intended final diameter as the foam cures, thus generating significant compressive stresses between the shell 10 and filler 30 to hold the filler 30 in place without a separate adhesive bond. The cured foam is characterized by the substantially complete absence of voids or cavities in the filler 30 and between the annular surface of the filler and the bat shell 10.

It will be appreciated that the heavier the filler 30 foam and thicker the shell wall, the heavier the bat; and the thinner the bat wall, the greater the necessity for a more dense and hard foam to maintain proper bat weight, balance and shell wall support. Since the compressive and shear strength of foams drop as density drops, a very thin metal shell wall requires a more dense and rigid filler 30. The foam also must not significantly interfere with the designed longitudinal flex of the shell which must be maintained since shell materials such as aluminum and titanium have a much higher stiffness and density than that of wood.

Longitudinal flexibility characteristics of the bat are matched end to end with those of a wood bat of corresponding weight and geometry by determining handle, tapered transition area and barrel flexibilities separately. Each test is performed by supporting the bat at two spaced locations about 15 inches apart. Accordingly, when testing the handle 12 one point of support is adjacent the knob 20 and when testing the barrel, one point of support is adjacent the barrel end of the bat. A vertical load, preferably about 80 pounds, is then applied at the midpoint of the span, i.e., 7.5 inches from either point of support, to ensure that the applied load causes a desired deflection similar to that caused by the same load applied to a wood bat. Test results indicate that the desired deflection in the handle 12 should be in the range of about 0.046–0.055 inches.

Supporting the barrel section 14 of the bat at two spaced locations about 15 inches apart similarly tests the longitudinal barrel flexibility. A vertical load, preferably about 80 pounds, is then applied to the barrel 14 at the mid-point of the span, i.e., 7.5 inches from either point of support, to ensure that the applied load causes a desired deflection similar to that caused by the same load applied to a wood bat. Test results indicate that the desired deflection in the barrel section should be about 0.0046 inches.

Supporting the bat at two spaced locations about 15 inches apart at either end of the tapered section 16 similarly tests the longitudinal flexibility of the tapered section. A vertical load, preferably about 80 pounds, is then applied to the tapered section at the mid-point of the span, i.e., 7.5 inches from either point of support, to ensure that the applied load causes a desired deflection similar to that caused by the same load applied to a wood bat. Test results indicate that the desired longitudinal deflection in the tapered section 16 should be about 0.029 inches.

Cross-sectional rigidity tests have also been conducted to determine the amount of radial displacement of the barrel 14, i.e., the shell wall, under a transversely applied load. These tests are made by horizontally supporting the barrel in a V-block and applying a vertically directed load of 550 pounds to a one inch square block pressed downwardly against the barrel 14 from above. A wood bat typically exhibits a cross-sectional displacement of 0.020". A typical prior art aluminum bat exhibits a cross-sectional displacement of 0.032". The thin wall bat of the present invention exhibits a comparatively high cross-sectional displacement of 0.104" when internally unsupported by a filler 30 and a cross-sectional displacement after filling (with the preferred syntactic foam) of 0.018"—i.e., substantially the same as the wood bat. A thin wall filled shell bat has thus been disclosed which performs substantially the same as a wood bat of generally corresponding geometry.

Figure 4:
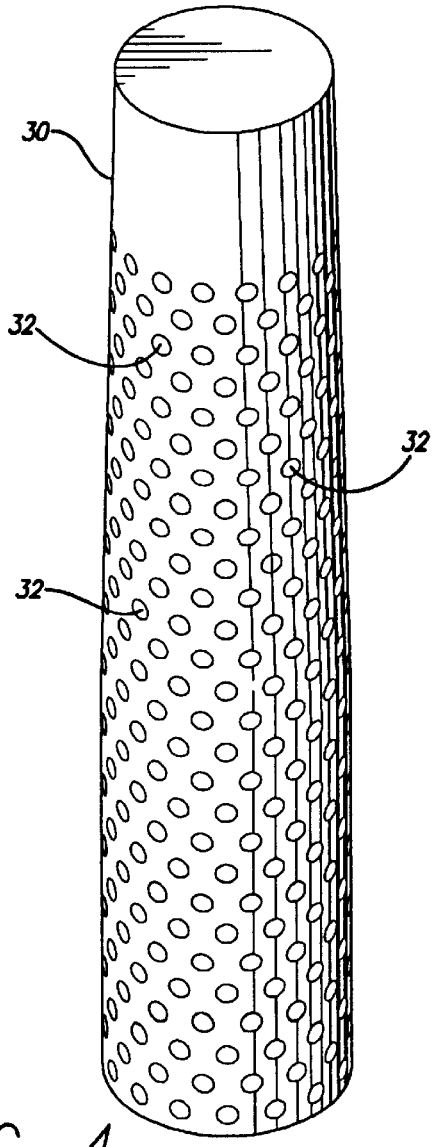
FIG. 4 is a perspective view of a perforated foam bat filler.

FIG. 4 shows a pre-cast or molded foam bat filler 30 having perforations 32 in the annular surface wherein the weight of a volume of the perforated foam (as opposed to the weight of an equivalent volume of unperforated foam) is such that the perforated filler 30 has a sectional density which falls within the density range of from 10 to 30 lbs/cu.ft. The filler 30 of the embodiment of FIG. 4 is conveniently formed by using a readily pourable foam which is, however, significantly heavier than the preferred density range. Foams having a density within the preferred density range are doughy and barely pourable and are therefore much more difficult to work with. Accordingly, the filler 30 is lightened without sacrificing the necessary support strength by forming perforations in the annular surface of the foam so that sectional density of the filler 30 is reduced to the preferred range. The perforated foam filler 30 of FIG. 4 can be formed in various ways such as by boring a pre-formed molded or cast solid filler or by using removable pins in the casting mold.

Fillers 30 which have satisfactorily performed in rigorous testing were made from a pourable DCPD resin foam having a density of about 41 lbs./cu. ft. with an adequate number of perforations in the annular surface of 15⁄64" to obtain a finished sectional density of 22.5 lbs./cu. ft.—well within the preferred range of 10–30 lbs./cu.ft. Pourable foams of 33 lbs./cu. ft. with 13⁄64" perforations in the annular surface to reduce the sectional density to the preferred range have also been satisfactorily tested. The testing procedure involved projection of 200 baseballs at a velocity of 136 mph onto the same spot on the barrel of the bat which satisfactorily withstood the testing without permanent denting. Similar testing of the tapered portion of the bat was also conducted by projecting 100 baseballs at a velocity of 100 mph onto the same spot without resulting denting.

Preferably the perforations or holes 32 are formed or drilled radially into the annular surface of the filler 30 although this is not considered strictly essential. The perforations 32 may comprise blind holes of about 1" in depth or through holes extending entirely through the filler 30. Slightly higher ball rebound speed from the bat can be expected if through holes are used. The pattern and spacing of the perforations 32 on the annular surface of the filler 30 is not considered critical but they are preferably formed in regular patterns on the annular surface of the filler 30 such as in circumferentially equally spaced longitudinally extending rows or in longitudinally equally spaced circles. The number and spacing of the perforations 32 must of course ensure that the filler 30 still contains adequate cast foam material to safely support the thin wall metal or metal alloy shell 10 to avoid denting or fatigue collapse thereof under extreme and normal conditions of use. If round hole perforations 32 are used, the minimum center to center spacing of the holes preferably should be not less than about twice the diameter of the holes. It is of course within the teachings of the invention to use other than round holes and/or by using a mixture of holes of differing sizes or shapes. It is believed that use of a larger number of smaller diameter holes rather than using a smaller number of larger diameter holes will result in a more durable filler.

Persons skilled in the art will appreciate that various additional modifications of the invention can be made from the above described embodiments and that the scope of protection is defined only by the limitations of the following claims.

What is claimed is:

1. A governed performance ball bat comprising:

a) a tubular exterior shell having a maximum outside diameter in a ball hitting area and a ratio of said maximum outside diameter to the wall thickness of the shell in the hitting area in the range of from 40:1–90:1; and b) a filler contacting and internally supporting an annular interior surface of the bat shell in the hitting area, said filler having a sectional density in the range of 10–30 lbs./cu. ft. and a hardness on a Shore D test apparatus in the range of 25–65.

2. The governed performance bat of claim 1, wherein said filler is a foam material.

3. The governed performance bat of claim 2, wherein said foam material has a shrinkage factor during curing of not greater than 1.0%.

4. The governed performance bat of claim 3, wherein said foam is a thermosetting resin having micro-bubbles mixed therein and a Shore D hardness in the range of 40–65.

5. The governed performance bat of claim 4, wherein said foam is di-cyclopentadiene (DCPD) resin.

6. The governed performance bat of claim 1, wherein said shell is aluminum, said ratio of maximum outside diameter to wall thickness of the shell in the hitting area is in the range of from 45:1 to 75:1 and said shell has a wall thickness in the hitting area in the range of 0.039–0.055 inches.

7. The governed performance bat of claim 6, wherein said filler is a foam material compressively restrained in the shell and characterized by the absence of an adhesive bond between said shell and said foam material.

8. The governed performance bat of claim 7, having an outside diameter in the hitting area of about 2 5⁄8 inches and wherein the sectional density of said foam is about 25 pounds per cubic foot and the Shore D hardness of said foam is about 55.

9. The governed performance bat of claim 1, wherein said filler is made from a pourable material having a density above said sectional density range and has perforations in an annular surface, said filler contacting said bat shell in the hitting area.

10. The governed performance bat of claim 9, wherein said perforations are radially directed.

11. The governed performance bat of claim 9, wherein said filler is a thermosetting resin foam having micro-bubbles mixed therein and a Shore D hardness in the range of 40–65.

12. The governed performance bat of claim 11, wherein said foam is di-cyclopentadiene (DCPD) resin.

13. The governed performance bat of claim 9, wherein said shell is aluminum, said ratio of maximum outside diameter to wall thickness of the shell in the hitting area is in the range of from 45:1 to 75:1 and said shell has a wall thickness in the hitting area in the range of 0.039–0.055 inches.

14. The governed performance bat of claim 13, having an outside diameter in the hitting area of about 2 5⁄8 inches and wherein the sectional density of said foam is about 25 pounds per cubic foot and the Shore D hardness of said foam is about 55.

15. A governed performance aluminum shell ball bat comprising:

a) an aluminum alloy shell having a ratio of maximum outside diameter to the wall thickness of the shell in the ball hitting area in the range of from 45:1–75:1; and b) a foam material contacting and internally supporting the bat shell in the hitting area, said foam having a sectional density in the range of 10–30 lbs./cu. ft. and a hardness on a Shore D test apparatus in the range of 40–65, said bat having longitudinal flexibility characteristics approximating those of a wood bat of identical geometry.

16. The governed performance bat of claim 15, wherein said filler is made from a pourable material and has perforations in an annular surface, said filler contacting said bat shell in the hitting area.

17. The governed performance bat of claim 16, wherein said perforations are radially directed and said pourable material has a density above said sectional density range.

18. The governed performance bat of claim 16, wherein said material is a syntactic foam.

19. The governed performance bat of claim 16, wherein said shell has a wall thickness in the hitting area in the range of 0.039–0.050 inches.

20. The governed performance bat of claim 19, having an outside diameter in the hitting area of about 2 ⅝ inches and wherein the density of said foam is about 25 pounds per cubic foot and the Shore D hardness of said foam is about 55.

21. The governed performance bat of claim 20, wherein said foam is a thermosetting resin having micro-bubbles mixed therein.

22. The governed performance bat of claim 21, wherein said foam is di-cyclopentadiene (DCPD) resin.

23. The governed performance bat of claim 15, wherein said foam is compressively restrained in the shell.

24. The governed performance bat of claim 23, wherein said foam has a shrinkage factor during curing of not greater than 1.0%.

25. The governed performance bat of claim 23, characterized by the absence of an adhesive bond between said metal shell and said foam filler material.

* * * * *